US005287587A

United States Patent [19]

Yonkers et al.

[11] Patent Number: 5,287,587

[45] Date of Patent: Feb. 22, 1994

[54] SELF-CONTAINED, COMPACT VACUUM/EXTRACTOR

[76] Inventors: Robert A. Yonkers, 3565 Apache Ct., Grandville, Mich. 49418; Brenda L. Reath, 472 Crescent, NE., Grand Rapids, Mich. 49503; Michael R. Blase, 2903 Montreat, NE., Grand Rapids, Mich. 49505

[21] Appl. No.: 757,249

[22] Filed: Sep. 10, 1991

[51] Int. Cl.[5] ..... A47L 7/00

[52] U.S. Cl. ..... 15/320; 15/321; 15/352; 15/353

[58] Field of Search ..... 15/321, 353

[56] References Cited

U.S. PATENT DOCUMENTS

| | | | |
|---|---|---|---|
| D. 263,842 | 4/1982 | Pearman, Jr. | D32/23 |
| 2,909,800 | 10/1959 | Grindle et al. | 15/321 |
| 3,048,961 | 8/1962 | Kemnitz | 55/471 |
| 3,332,101 | 7/1967 | Leinfelt et al. | 15/321 |
| 4,068,340 | 1/1978 | Forward | 15/321 |
| 4,185,354 | 1/1980 | Brazier | 15/321 |
| 4,307,484 | 12/1981 | Williams | 15/321 |
| 4,367,565 | 1/1983 | Parise | 15/321 |
| 4,397,057 | 8/1983 | Harbeck | 15/321 |
| 4,800,615 | 1/1989 | Ostroski et al. | 15/353 |
| 4,809,396 | 3/1989 | Houser | 15/353 X |
| 4,827,562 | 5/1989 | Blase et al. | 15/321 X |

FOREIGN PATENT DOCUMENTS

| | | |
|---|---|---|
| 3518545 | 5/1985 | Fed. Rep. of Germany . |
| 3739731 | 11/1987 | Fed. Rep. of Germany . |
| 1121225 | 2/1967 | United Kingdom . |

*Primary Examiner*—Chris K. Moore

*Attorney, Agent, or Firm*—Price, Heneveld, Cooper, Dewitt & Litton

[57] ABSTRACT

A vacuum extractor has a tank assembly including an outer tank and a coaxial inner tank. The inner tank has an open top which is reversibly closed by a cover assembly which includes a vacuum source and a liquid pump. The cover assembly also includes a hose connection in communication with said inner tank and said vacuum source enabling said inner tank to receive either wet or dry materials. The outer tank is substantially closed having an input port closed by a closure member configured in the form of a measuring cup. The outer tank is used for containing a cleaning material which can be accessed through a hose which passes through an aperture in the outer wall of the tank. The hose has an external connector for supplying cleaning material to the liquid pump in the cover assembly which, in turn, supplies the cleaning material to a cleaning tool. The unit is supported by casters which are recessed into the bottom of the tank assembly. A pair of opposed caster recesses are shaped to provide handholds to assist in emptying the separate tanks. The inner tank can be emptied by pouring in a first direction while both inner and outer tanks can be emptied simultaneously by pouring in a second direction opposite to the first direction.

3 Claims, 2 Drawing Sheets

SELF-CONTAINED, COMPACT VACUUM/EXTRACTOR

BACKGROUND OF THE INVENTION

The present invention relates to a compact extractor which can be used for both wet and dry cleaning. In a typical extractor, a tank is used to contain a cleaning solution such as an aqueous detergent solution. This solution is then applied to the surface being cleaned such as a carpet, floor, upholstery, drapes, or the like through a suitable spray nozzle associated with a vacuum cleaning head. The cleaning solution is sprayed on the surface and then promptly extracted with the vacuum cleaning head to remove dirt and as much of the cleaning solution as possible.

Since the use of an extractor usually involves the transfer of a cleaning solution from one tank to a recovery or dirty cleaning solution tank, such devices have two tanks. The tanks have either been totally separate units which were set on the floor and then connected with suitable vacuum and liquid transfer hoses or the two tanks were combined into a single assembly. In order to combine the tanks into a single assembly, it was a common practice to have one of the tanks separable from the other and merely set within the outer tank. This presented a problem, however, in that the inner tank could not be removed from the outer tank without trailing liquid from the outer surface of the inner tank. When the two tanks were assembled as stacked tanks, it was a common practice to have the cleaning solution in the outer tank or bottom tank associated with a liquid pump and to have the spent or dirty solution tank stacked on top of this tank. This presented the problem in that the clean solution tank also had the weight of the pump associated with it so that when it had to be maneuvered or handled in filling and emptying the unnecessary weight of the pump also had to be contended with.

When the pump and vacuum source were mounted or assembled in a separate unit which was mounted on top of the stacked tanks, it was necessary to connect a hose from the pump to the clean liquid solution. This connection was usually made on the bottom of the upper assembly with the hose then trailing down into the tank. This presented a problem in that the top could not be removed without drawing the hose from the clean solution tank and, in turn, dripping liquid onto the person removing the upper assembly or onto the floor or carpet area adjacent to the assembly. It can be seen from the above discussion that the prior extractors had problems associated both with the tanks and with the pump and its hoses.

SUMMARY OF THE INVENTION

The aforementioned problems have been substantially alleviated by the compact extractor of the present invention in which both the clean and spent cleaning solution tanks are supported in a single mobile assembly. The tanks are substantially coaxial with the spent solution tank being permanently mounted within the clean solution tank.

The cleaning solution can be prepared in the clean solution tank by adding the components through a port in the upper edge of the tank which is closed by a measuring cup-shaped plug.

The vacuum source and high pressure liquid pump are mounted in a cover assembly which sits on top of the tank assembly. An external plug-in solution line connects the contents of the cleaning solution tank to the input of the liquid pump. The liquid exits the cover assembly through a conduit associated with a flexible hose, a wand and a vacuum cleaning head. The cleaning solution is sprayed on the surface being cleaned, then is quickly picked up by the vacuum cleaning head and returned through the wand and hose to the spent solution tank.

The tank assembly is designed so that the spent solution tank can be emptied by tilting the unit in a first direction and both tanks can be emptied by tilting the tank assembly in a second direction opposite to the first direction.

The tank assembly is supported on casters which are recessed into the bottom of the tank to increase the stability of the compact extractor. A pair of oppositely positioned recesses have the outer edges shaped to provide handholds for use in emptying the two tanks. The tank assembly can be lifted by a pivotally mounted handle and then either handhold can be grasped to empty either the spent solution tank or both tanks. The handholds help to stabilize the tank assembly and determine the proper direction for tilting the assembly.

The compact extractor can also be used as a dry vacuum by adding a filter, and by not adding cleaning solution or, if solution is present, by not connecting the plug-in solution feed to the input of the liquid pump. The unit can then be used as a conventional vacuum cleaner with the dirt being collected through the vacuum head, the wand and flexible hose which are connected to the vacuum source through the spent solution tank. The dirt is collected in the spent solution tank.

DETAILED DESCRIPTION OF THE PREFERRED EMBODIMENTS

Figure 1:
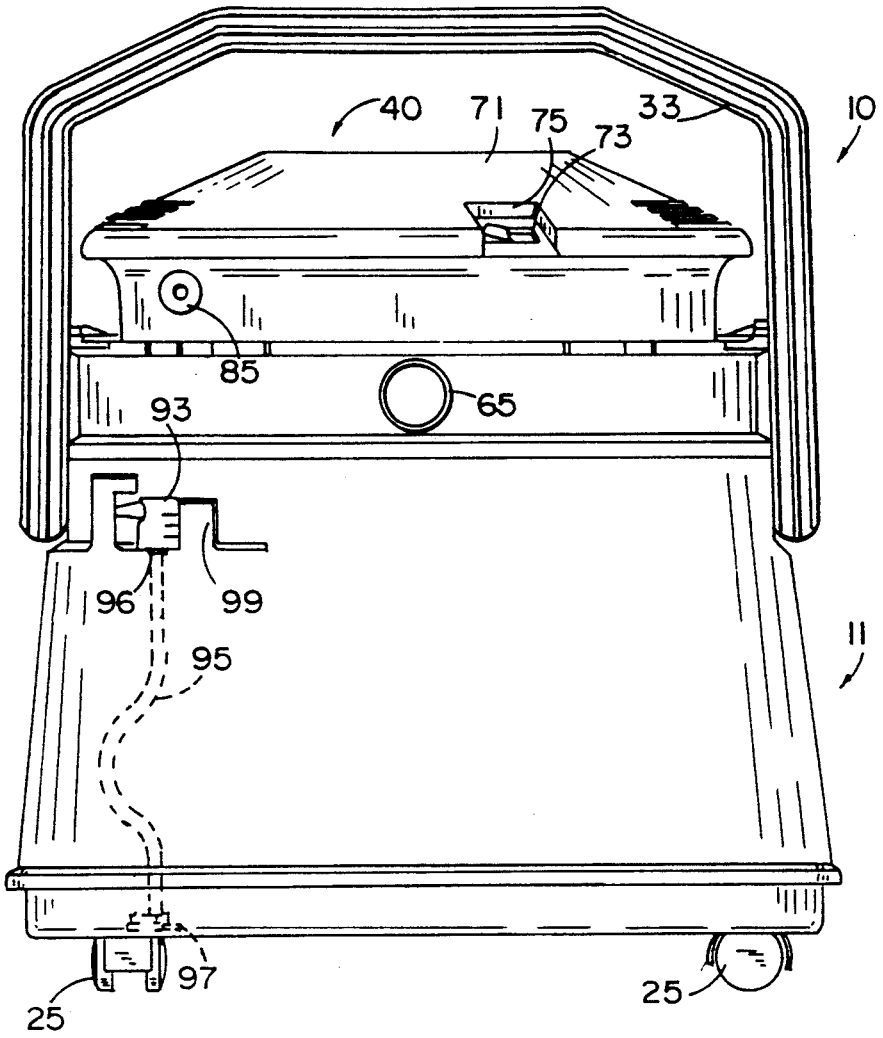
FIG. 1 is an elevational view of the compact extractor.
Figure 2:
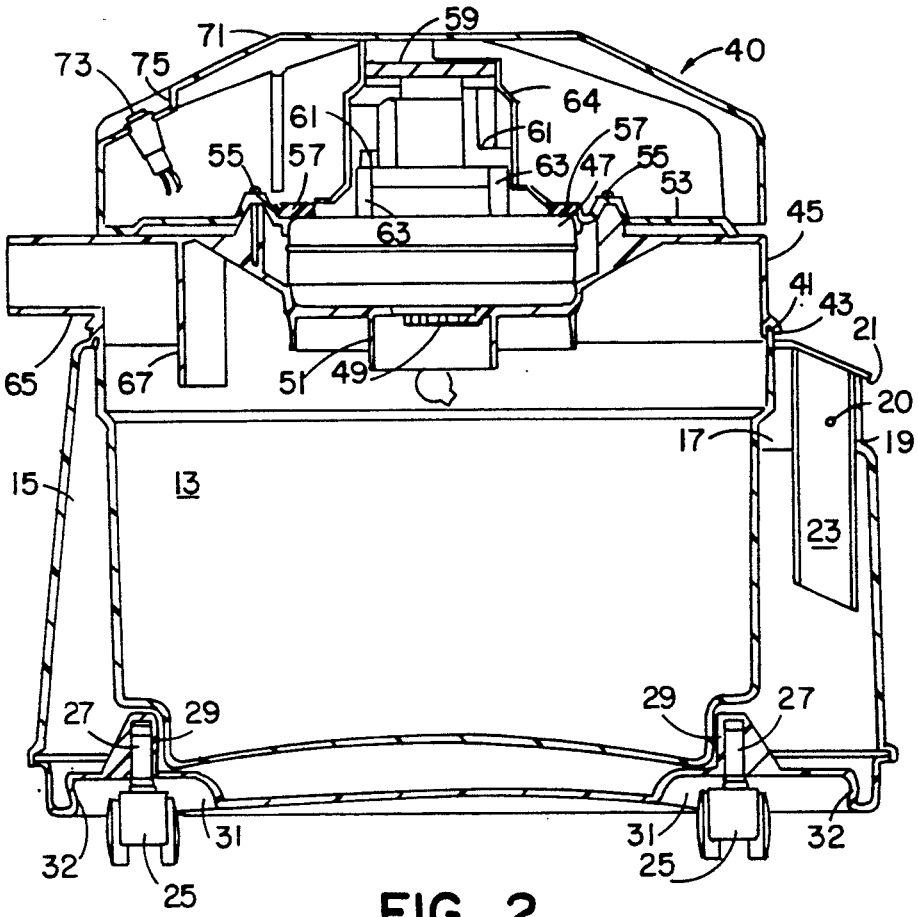
FIG. 2 is a partial sectional view showing the interior of the compact extractor.

Referring to FIGS. 1 and 2, the compact extractor is shown and indicated generally by the number 10. The extractor has a tank assembly 11 comprising an inner tank 13 permanently mounted within an outer tank 15. In the operation of the compact extractor, tank 13 is used to contain recovered dirty or spent cleaning solution while outer tank 15 is used to contain fresh cleaning solution.

Outer tank 15 of tank assembly 11 has an input port 17 (FIG. 2) which is closed by a plug assembly 19. Plug assembly 19 is in the form of a measuring cup having a handle portion 21 and a container portion 23 which is shown inverted in FIG. 2 with the open end of the measuring cup facing downward. In the operation of the compact extractor, warm or hot water can be added to tank 15 through the input port 17 until a suitable volume of liquid is contained within the fresh solution tank. The amount of cleaning material, for example detergent or rug cleaning shampoo, can be measured into upright cup portion 23 of plug 19, and then poured into cleaning tank 15 with the cup being placed into port 17 closing the input port so the cleaning solution cannot splash out as the compact extractor is moved about the floor. In order to hold plug assembly 19 in place in input port 17, a small projection 20, only one of which is shown, is provided on each side of the cup. Projection 20 provides tactile feel to the user that plug 19 is locked in place and will not be dislodged by sloshing liquid in tank 15. If the cleaning solution tends to slosh or splash it will be retained in the tank and deflected away from port 17 by measuring cup portion 23 of plug 19.

The several components forming the tank assembly can be manufactured using conventional plastic molding techniques. The walls and bottom of the tank assembly can be joined together using suitable adhesive materials or the components can be heat sealed together using suitable tooling or high frequency techniques. Polypropylene and polycarbonate are representative plastic materials which can be used. Suitable fillers and pigments can be used in the plastic material If desired, the outer walls of the clean solution tank 15 and recovery tank 13 can be made of a transparent or translucent material so that the level of material in the tanks can be monitored.

Tank assembly 11 is supported on the surface being cleaned, for example a floor or carpet, by a plurality of spaced recessed casters 25. Casters 25 are supported by rotatably mounted shafts 27 in suitably shaped sockets 29. Each of casters 25 is positioned in a recessed portion 31 of solution tank 11. Recessing the caster assemblies tends to stabilize the compact extractor as it is being moved about the floor during the course of the cleaning process.

Again referring to FIGS. 1 and 2, the compact extractor has a handle assembly 33 which is pivotally attached to each side of tank assembly 11 by a suitable pivot assembly (not shown). In FIG. 2 the handle assembly 33 is not shown but would be positioned normal to the figure, in and out of the figure with the handle being adapted to pivot to the left or right.

A cover assembly 40 closes the top of recovery tank 13 and is supported by the upper edge 41 of the tank assembly which extends about the periphery of the tank, edge 41 is received within a downwardly directed peripheral U-shaped socket portion 43 extending about the edge of cover member 45. Impeller housing 47 containing a suitable impeller (not shown) for generating a vacuum within tank assembly 11 is supported by cover member 45. The housing has an air intake 49 on the bottom which is surrounded by a collar 51. A suitable shutoff assembly (not shown) is positioned inside tank assembly 11 and will rise as the tank fills with spent cleaning solution until air intake 49 is sealed and protected from liquid. Impeller housing 47 is clamped in place by a pressure plate 53 which is attached to cover member 45 by spaced screws and washers 55. A resilient seal 57 is provided about impeller housing 47 to preclude air being exhausted into the electrical compartment.

An electric motor and fan assembly 59 is mounted on top of impeller housing 47. The electric motor and fan are fastened to housing 47 by bolts 61 which are threaded into suitable threaded standoffs 63. A protective cover member 64 protects users of the extractor from possible contact with the fan blade. It also supports the center of cover 71.

Cover member 45 has a connector 65 to which a conventional flexible hose can be connected. Within and depending from cover member 45 is a baffle 67 which deflects dirt and liquid toward the bottom of inner tank 13 when it is drawn in through a hose connected to connector 65. A top cover member 71 covers the electric motor and fan assembly 59 to protect users of the extractor from accidental contact with any electrical or moving mechanical part. An operating switch 73 is positioned within a recess portion 75 on cover member 71. Switch 73 is connected so that it can activate both the vacuum source and the liquid pump.

Figure 3:
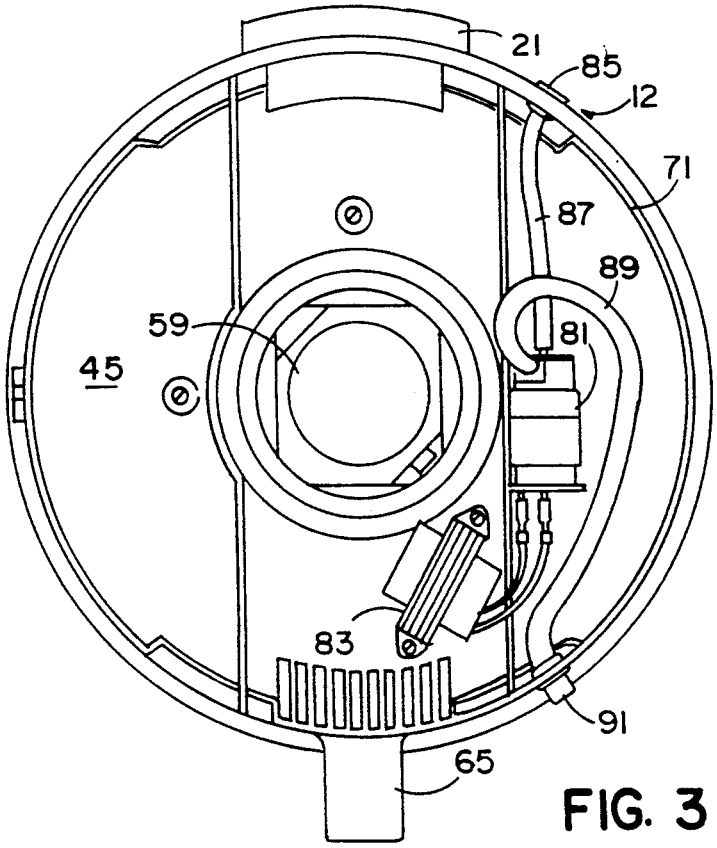
FIG. 3 is a plan view looking down into the compact extractor with the upper portion of the cover removed.

Now referring to FIG. 3 which shows the interior of cover assembly 40 of the compact extractor with a portion of cover member 71 removed, electric motor and fan assembly 59 can be seen centrally disposed on member 53. A liquid pump 81 is also mounted on member 53 and is connected to a suitable source of electric power through a step-down transformer 83. The liquid pump 81 has an input quick connect/disconnect connector 85 on the outer surface of cover member 71 to which a liquid connector 93 (FIG. 1) can be attached to convey cleaning solution from clean solution tank 15 through the hose 87 and to pump 81. Hose 89 carries the pressurized liquid exiting pump 81 to connector 91 on the exterior of cover member 45 to which a flexible hose can be connected to carry the cleaning solution to a conventional spray nozzle associated with a vacuum cleaning head.

It is preferred to use a self-priming liquid pump, for example, a gear pump in the unit of the present invention. A non-self-priming pump can also be used if suitable steps are taken to provide for priming the pump.

Cover assembly 40 including cover member 71 and handle 33 can be made of the same types of plastic materials used to fabricate the tank assembly. Suitable fillers can be added for strength and color.

The cleaning solution used in the extractor is contained within outer tank 15. In order to gain access to the cleaning solution, a connector 93 (FIG. 1) is attached to a hose 95 which passes through an aperture 96 in the outer wall of tank 15. Hose 95 extends to the bottom of tank 15 where it is connected to a filter assembly 97. Hose 95 is preferably long enough so that a portion of the hose can be withdrawn from tank 15 far enough for connector 93 to be inserted into input quick connect/disconnect connector 85 while still allowing filter assembly 97 to rest on the bottom of the tank. Connector 93 is supported within a shaped holder 99 which closely fits the connector keeping the connector free of dirt.

It should be noted that the connection between the cleaning solution and the liquid pump is made outside of the compact extractor. The user does not have to reach within the unit to make the connection nor are there any drippy hoses to contend with. To connect the cleaning solution to the pump, the user merely plugs connector 93, which is a quick connect/disconnect type fitting, into input quick connect/disconnect connector 85. The nozzle 94 of connector 93 is shaped so that it can be grasped by quick connect/disconnect connector 85 without fastening threaded collars or the like and without the need of tools. When finished, connector 93 is removed from input connector 85 and any cleaning solution in connector 93 and hose 95 will return to tank 15. Connector 93 can then be placed in close fitting holder 99 until needed again.

When it is desired to use the compact extractor as a dry vacuum, no cleaning solution would need to be placed in tank 15. It is also possible, however, to have solution in tank 15 and not use the solution by merely not connecting connector 93 to liquid pump input quick connect/disconnect connector 85. No solution will then be carried to the liquid pump and the compact extractor can merely be used as a dry vacuum with dirt being collected through the vacuum cleaning head and flexible hose (not shown) entering internal tank 13. On the other hand, when it is desired to use the compact extractor for wet cleaning, a suitable solution can be prepared in tank 15 using measuring cup plug 19 and then connecting connector 93 to liquid input quick connect/disconnect connector 85 on the outside of upper cover 71 which, in turn, connects the cleaning solution to liquid pump 81 enabling the pump to pressurize the solution and eject it through connector 91 to a suitable hose and spray head (not shown).

When the compact extractor is used for liquid cleaning, a transfer takes place of liquid from clean solution tank 15 to recovery or spent solution tank 13. Tank 13 can be emptied by removing cover assembly 40 and then picking tank assembly 11 up by handle 33 and tilting the assembly to the left (FIG. 2). In this way, tank 13 can be emptied without emptying tank 15. In emptying the compact extractor, the weight of the electric motor and impeller and the liquid pump is removed from the tank assembly substantially lowering the weight of the overall extractor. Since, as mentioned before, it is merely a liquid transfer process between the clean tank and the recovery tank, the approximate overall weight of the tank assembly is not changed and the assembly can merely be dumped as previously described. It is also possible to use the extractor until tank 13 is full and then dump the inner tank and make a new charge of cleaning solution in tank 15 and continue the process. When the cleaning task is completed, both tanks 13 and 15 can be emptied simultaneously by removing measuring cup plug 19 from port 17 and then tilting tank assembly 11 in a direction opposite to the first direction or to the right, as shown in FIG. 2. The contents of tank 15 will exit through port 17 while the contents of tank 13 will pour over edge 41.

Figure 4:
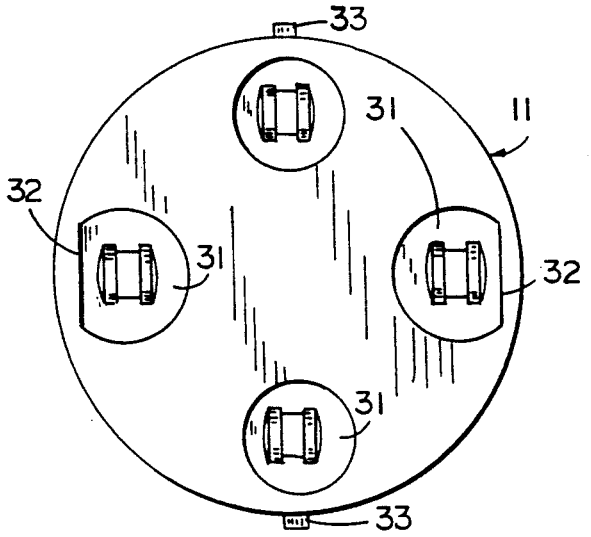
FIG. 4 is a plan view of the bottom of the compact extractor.

In order to encourage the proper emptying of tanks 13 and 15, caster recesses 31 on the bottom of solution tank 11 are configured to provide a handhold on each side of the bottom away from handle 33. As seen in FIG. 4, handle 33 is at the top and bottom while handholds 31 at the left and right, as shown, have a substantially flat edge portion 32 forming a hand grip. The person emptying the compact extractor can then hold the weight of the tank and securely grasp the specific handhold necessary to empty either the spent cleaning fluid tank or both tanks. If a person attempts to empty either tank by pouring over the handle, he/she will first find the handle in the way. Also in gripping the bottom, or attempting to grip the bottom of the tank, he/she will not find a handhold but only caster recess 31 shaped to provide room for the caster to rotate.

It can be seen from the above description that a compact extractor is provided which is adapted for both wet and dry cleaning. The unit is also designed so that the weight of the vacuum source and liquid pump is removed from the tank assembly before the tank assembly is lifted and tilted for emptying. The tank assembly also has shaped caster recesses forming handholds to encourage the operator to dump the tank in the proper direction.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. A vacuum extractor, comprising:

a tank assembly comprising a solution tank for holding cleaning solution and a recovery tank for holding spent cleaning solution, dirt, and debris recovered from a surface being cleaned;

a cover assembly;

a vacuum source and a liquid pump in said cover assembly;

an input hose connection in communication with said recovery tank and said vacuum source providing a passage into said recovery tank for recovered cleaning solution, dirt, and debris;

an external quick connect/disconnect input connector on the outer surface of said cover assembly connected to said liquid pump for supplying cleaning solution from said solution tank to said liquid pump and an external output connector on said cover assembly for connecting the output of said liquid pump to an external cleaning device; and an extendable plug-in solution feed extending out of an aperture in a side of said solution tank for conveying the contents of said solution tank to said external quick connect/disconnect input connection for said liquid pump, said plug-in solution feed terminating in a quick connect/disconnect connector which is adapted to be reversibly and releasably connected to said external quick connect/disconnect input connector for said liquid pump on said cover assembly;

wherein said recovery tank can be emptied by tilting said tank assembly in a first direction and both said recovery and solution tanks can be emptied by tilting said tank assembly in a second direction opposite to said first direction.

2. A vacuum extractor, comprising:

a tank assembly comprising a solution tank for holding cleaning solution and a recovery tank for holding spent cleaning solution, dirt, and debris recovered from a surface being cleaned;

a cover assembly;

a vacuum source and a liquid pump in said cover assembly;

an input hose connection in communication with said recovery tank and said vacuum source provided a passage into said recovery tank for recovered cleaning solution, dirt, and debris;

an external quick connect/disconnect input connector on the outer surface of said cover assembly connected to said liquid pump for supplying cleaning solution from said solution tank to said liquid pump and an external output connector on said cover assembly for connecting the output of said liquid pump to an external cleaning device; and an extendable plug-in solution feed extending out of an aperture in a side of said solution tank for conveying the contents of said solution tank to said external quick connect/disconnect input connection for said liquid pump, said plug-in solution feed terminating in a quick connect/disconnect connector which is adapted to be reversibly and releasably connected to said external quick connect/disconnect input connector for said liquid pump on said cover assembly;

wherein said solution tank has an input port which is reversibly closed by a plug configured in the form of a measuring cup.

3. A vacuum extractor, comprising:

a tank assembly comprising a solution tank for holding cleaning solution and a recovery tank or holding spent cleaning solution, dirt, and debris recovered from a surface being cleaned;

a cover assembly;

a vacuum source and a liquid pump in said cover assembly;

an input hose connection in communication with said recovery tank and said vacuum source providing a passage into said recovery tank for recovered cleaning solution, dirt, and debris;

an external quick connect/disconnect input connector on the outer surface of said cover assembly connected to said liquid pump for supplying cleaning solution from said solution tank to said liquid pump and an external output connector on said cover assembly for connecting the output of said liquid pump to an external cleaning device; and an extendable plug-in solution feed extending out of an aperture in a side of said solution tank for conveying the contents of said solution tank to said external quick connect/disconnect input connection for said liquid pump, said plug-in solution feed terminating in a quick connect/disconnect connector which is adapted to be reversibly and releasably connected to said external quick connect/disconnect input connector for said liquid pump on said cover assembly;

wherein said extendable plug-in solution feed comprises an extendable flexible hose which is stored in said solution tank and which extends through an aperture in the wall of said solution tank, said aperture being above the level of the solution in said solution tank, said extendable flexible hose having a quick connect/disconnect fitting on the end thereof which is held in a shaped holder when said plug-in solution feed is not operatively connected to said liquid pump.

* * * * *

UNITED STATES PATENT AND TRADEMARK OFFICE

CERTIFICATE OF CORRECTION

PATENT NO. : 5,287,587

DATED : February 22, 1994

INVENTOR(S) : Yonkers et al.

It is certified that error appears in the above-indentified patent and that said Letters Patent is hereby corrected as shown below:

Column 3, line 21
After "material" insert --.--;

Column 6, line 56, claim 2
"provided" should be --providing--;

Signed and Sealed this

Twentieth Day of September, 1994

*Attest:*

*Attesting Officer*

BRUCE LEHMAN

*Commissioner of Patents and Trademarks*